US006254762B1

(12) United States Patent
Uno et al.

(10) Patent No.: US 6,254,762 B1
(45) Date of Patent: Jul. 3, 2001

(54) PROCESS AND ELECTROLYTIC CELL FOR PRODUCING HYDROGEN PEROXIDE

(75) Inventors: Masaharu Uno; Shuhei Wakita; Yoshinori Nishiki, all of Kanagawa (JP)

(73) Assignee: Permelec Electrode Ltd., Kanagawa (JP)

( * ) Notice: Subject to any disclaimer, the term of this patent is extended or adjusted under 35 U.S.C. 154(b) by 0 days.

(21) Appl. No.: 09/405,002

(22) Filed: Sep. 27, 1999

(30) Foreign Application Priority Data

Sep. 28, 1998 (JP) ..... 10-289988

(51) Int. Cl.[7] ..... C25B 1/30

(52) U.S. Cl. ..... 205/466; 204/263; 204/632

(58) Field of Search ..... 205/466; 204/632, 204/263

(56) References Cited

U.S. PATENT DOCUMENTS 5,437,771 * 8/1995 Shimamune et al. ..... 205/466
5,593,554 * 1/1997 Yamanaka et al. ..... 204/632
5,705,050 * 1/1998 Sampson et al. ..... 205/746

* cited by examiner

*Primary Examiner*—Arun S. Phasge
(74) *Attorney, Agent, or Firm*—Sughrue, Mion, Zinn, Macpeak & Seas, PLLC

(57) ABSTRACT

A process and apparatuses for producing hydrogen peroxide which provides good current density and production efficiency from an electrolytic liquid having an exceedingly low conductivity, such as ultrapure water. An electrolytic cell main body containing an anode 5 and a cathode 6 which are electrically connected to each other via ion-exchange resin particles 9 is used to conduct electrolysis while maintaining the electrical connection. High-purity, high-concentration hydrogen peroxide is produced at a high current efficiency even when the electrolytic liquid has an exceedingly low conductivity.

14 Claims, 2 Drawing Sheets

PROCESS AND ELECTROLYTIC CELL FOR PRODUCING HYDROGEN PEROXIDE

FIELD OF THE INVENTION

The present invention relates to a process and electrolytic cell for producing hydrogen peroxide at a high current efficiency. More particularly, this invention relates to a process and electrolytic cell for producing hydrogen peroxide at a high current efficiency using ultrapure water as a feed material in order to avoid impurity inclusion in the hydrogen peroxide that is produced

BACKGROUND OF THE INVENTION

Hydrogen peroxide is a useful basic chemical indispensable to the food, medicine, pulp, textile and semiconductor industries Hitherto, hydrogen peroxide has been mass-produced by a continuous synthesis process in which a 2-alkylanthraquinol is caused to autoxidize to obtain the target compound, and the anthraquinone that is simultaneously obtained is reduced with hydrogen to the original anthraquinone derivative However, there is a growing need for an on-site hydrogen peroxide production apparatus. This is because a troublesome operation, e.g., repeated rectification, is necessary for purifying the mass-produced reaction product, and because hydrogen peroxide is an unstable substance incapable of longterm storage. Also, care must be taken to ensure safety in transportation and to avoid pollution.

In power plants and factories where seawater is utilized as cooling water, a technique for preventing the attachment of organisms to the inside of a condenser has been employed which comprises directly electrolyzing seawater to generate hypochlorous acid and utilizing the acid to inhibit organism attachment. However, restrictions are being placed on the use of hypochlorous acid from the standpoint of environmental conservation. This is intended to prevent hypochlorous acid from reacting with marine organisms and organic substances present in the seawater to form organochlorine compounds, which reaction products may cause secondary pollution. On the other hand, it has been reported that addition of a minute amount of hydrogen peroxide to the cooling water effectively prevents the attachment of organisms. It has further been reported that addition of hydrogen peroxide is also effective in maintaining the quality of water for use in fish breeding farms. However, there are still problems concerning safety in hydrogen peroxide transportation and pollution abatement as stated above.

Processes for producing hydrogen peroxide through the reduction reaction of oxygen gas have hitherto been proposed. U.S. Pat. No. 3,693,749 discloses several apparatuses for the electrolytic production of hydrogen peroxide, while U.S. Pat. No. 4,384,931 discloses a process for producing an alkaline hydrogen peroxide solution with an ion-exchange membrane. U.S. Pat. No. 3,969,201 proposes a hydrogen peroxide production apparatus having a carbon cathode of a three-dimensional structure and an ion-exchange membrane. However, in these processes, the amount of an alkali which inevitably generates simultaneously with hydrogen peroxide increases almost in proportion to the amount of hydrogen peroxide that is produced. Consequently, the hydrogen peroxide solution that is obtained has limited uses because the alkali concentration thereof is too high relative to the concentration of hydrogen peroxide.

U.S. Pat. Nos. 4,406,758, 4,891,107, and 4,457,953 disclose processes for hydrogen peroxide production in which a porous diaphragm and a hydrophobic carbon cathode are used to obtain an alkaline aqueous hydrogen peroxide solution having a small alkali proportion (a low sodium hydroxide/hydrogen peroxide ratio by weight). These processes, however, have drawbacks in that the control of operation conditions is troublesome. This is because the amount of electrolyte solution moving from the anode chamber to the cathode chamber and the rate of movement are difficult to control, and especially because hydrogen peroxide does not generate in a constant proportion.

In the *Journal of Electrochemical Society*, Vol. 130, pp. 1117-(1983), a method is proposed for stably obtaining an acidic hydrogen peroxide solution in which a cation- and anion-exchange membrane is used and sulfuric acid is fed to an intermediate chamber. *Denki Kagaku*, Vol.57, p.1073 (1989) reports a technique for improving performance by using united membrane electrodes as an anode Furthermore, the *Journal of Applied Electrochem.*, 25 (1995) pp.613–627 describes electrolytic processes for hydrogen peroxide synthesis known at that time. However, these techniques are disadvantageous in cost because the electric power consumption rate is too high, and further have a drawback in that sulfuric acid is used and this unavoidably results in inclusion of the acid. Hence, a fully satisfactory process for hydrogen peroxide production has not yet been obtained.

The *Journal of Applied Electrochemistry*, Vol.25, pp.613-(1995) discloses various processes for electrolytically yielding hydrogen peroxide. Each of these processes is intended to efficiently yield hydrogen peroxide in an atmosphere of an aqueous alkali solution. When pure water, ultrapure water, or the like, for which an alkali such as KOH or NaOH is indispensable, is used as a feed material, the hydrogen peroxide thus produced is more valuable because it contains no impurities. The *Journal of Electrochemical Society*, Vol.141, pp.1174-(1994) proposes a technique of electrolysis in which pure water as a feed material and an ion-exchange membrane are used to synthesize ozone and hydrogen peroxide on the anode and the cathode, respectively. This technique, however, is impractical because the current efficiency thereof is low. Although a similar method in which the efficiency of synthesis increases with increasing voltage has been reported, this method is impractical from the standpoint of safety. Furthermore, an electrolytic process in which a palladium foil is used has been proposed. However, this process has limited uses because the hydrogen peroxide solution thus produced has a low hydrogen peroxide concentration.

In these processes for the electrolytic production of hydrogen peroxide, a two-chamber electrolytic cell, i.e., a cell partitioned into an anode chamber and a cathode chamber with an ion-exchange membrane as a diaphragm, or a three-chamber electrolytic cell, i.e., a cell partitioned into an anode chamber, an intermediate chamber, and a cathode chamber with ion-exchange membranes, is used to conduct electrolysis while feeding water to one of these electrode chambers. The electrolytic liquid feed in these processes contains an electrolyte in a concentration as low as from several 100 ppm to about 10,000 ppm so as to impart electrical conductivity.

However, the electrolytic liquid, even when containing an electrolyte, has a high resistance with an electrical conductivity of about from 100 to 10,000,000 ωcm. Consequently, the current density in those processes is about 5 $A/dm^2$ at the most and is usually as low as 1 $A/dm^2$. The prior art processes therefore have a problem in that the equipment is exceedingly large when a large amount of hydrogen peroxide is needed. In addition, the above processes have a drawback in that the consumption of electrodes is accelerated although the reason therefor is unclear. According to the experiences of the present inventors, even a platinum electrode is consumed at a rate from several to ten or more times the consumption rate in the electrolysis of ordinary electrolyte solutions.

The electrolyte is a metal salt in most cases. When an electrolytic liquid containing a metal salt is electrolyzed, the hydrogen peroxide thus produced is contaminated with metal ions. Use of this hydrogen peroxide, e.g., for cleaning semiconductors is problematic in that the metal ions contained in the hydrogen peroxide adhere as an impurity to the semiconductor surface, leading to insulation failure. Although use of ammonium salts is less apt to cause such a problem as opposed to metal salts, the ammonium ions may remain in the hydrogen peroxide thus produced to cause slight fouling.

In the case where a neutral diaphragm is used as a partition for separating an anode chamber from a cathode chamber, the two electrodes are arranged close to each other respectively on both sides of the diaphragm in order to attain a reduced electrolytic voltage. However, even when such an arrangement is employed, various electrolysis products which have been generated in each chamber move to the opposite electrode chamber. That is because of the high gas and liquid permeability of the diaphragm which again causes oxidation or reduction, thereby resulting in reduced efficiency. Since the electrolytic liquid generally has a low concentration, it has a high electrical resistance. Specifically, there are cases where the electrolytic voltage at an electrode-to-electrode distance of about 1 mm is as high as 10 V or above even when the current density is as extremely low as 1 $A/dm^2$. Although this drawback can be alleviated to some degree by increasing the electrode-to-electrode distance, not only complete elimination thereof is impossible but the increased resistance resulting from the increased electrode-to-electrode distance results in a significant increase in power consumption. There is another problem in that the resistance loss causes considerable heat generation and this necessitates cooling of the electrolytic liquid, resulting in a further increase in power consumption.

SUMMARY OF THE INVENTION

It is therefore an object of the present invention to provide a process and electrolytic cell capable of yielding a relatively large amount of hydrogen peroxide at a high current efficiency while attaining a small power consumption, even when an electrolytic liquid having increased resistivity is used for the hydrogen peroxide production.

The above object of the present invention has been achieved by providing a process for producing hydrogen peroxide in an electrolytic cell partitioned with one or more diaphragms into at least an anode chamber including an anode electrode and a cathode chamber including a cathode electrode and having an ion-conductive material disposed between the anode electrode and the cathode electrode, which comprises supplying water and an oxygen-containing gas to said electrolytic cell and passing an electric current through the electrolytic cell to electrolyze the water.

In one embodiment of the invention, the electrolytic cell for producing hydrogen peroxide is partitioned with a diaphragm into an anode chamber including an anode electrode and cathode chamber including a cathode electrode and having an ion-conductive material packed in at least one of the anode and cathode chambers, said diaphragm being electrically connected to the anode or cathode via the ion-conductive material. In another embodiment, the electrolytic cell for producing hydrogen peroxide is partitioned with first and second diaphragms into an anode chamber including an anode electrode, an intermediate chamber and a cathode chamber including a cathode electrode and having an ion-conductive material packed in the intermediate chamber, said first and second diaphragms being electrically connected to each other via the ion-conductive material.

[Description of Symbols]

Figure 1:
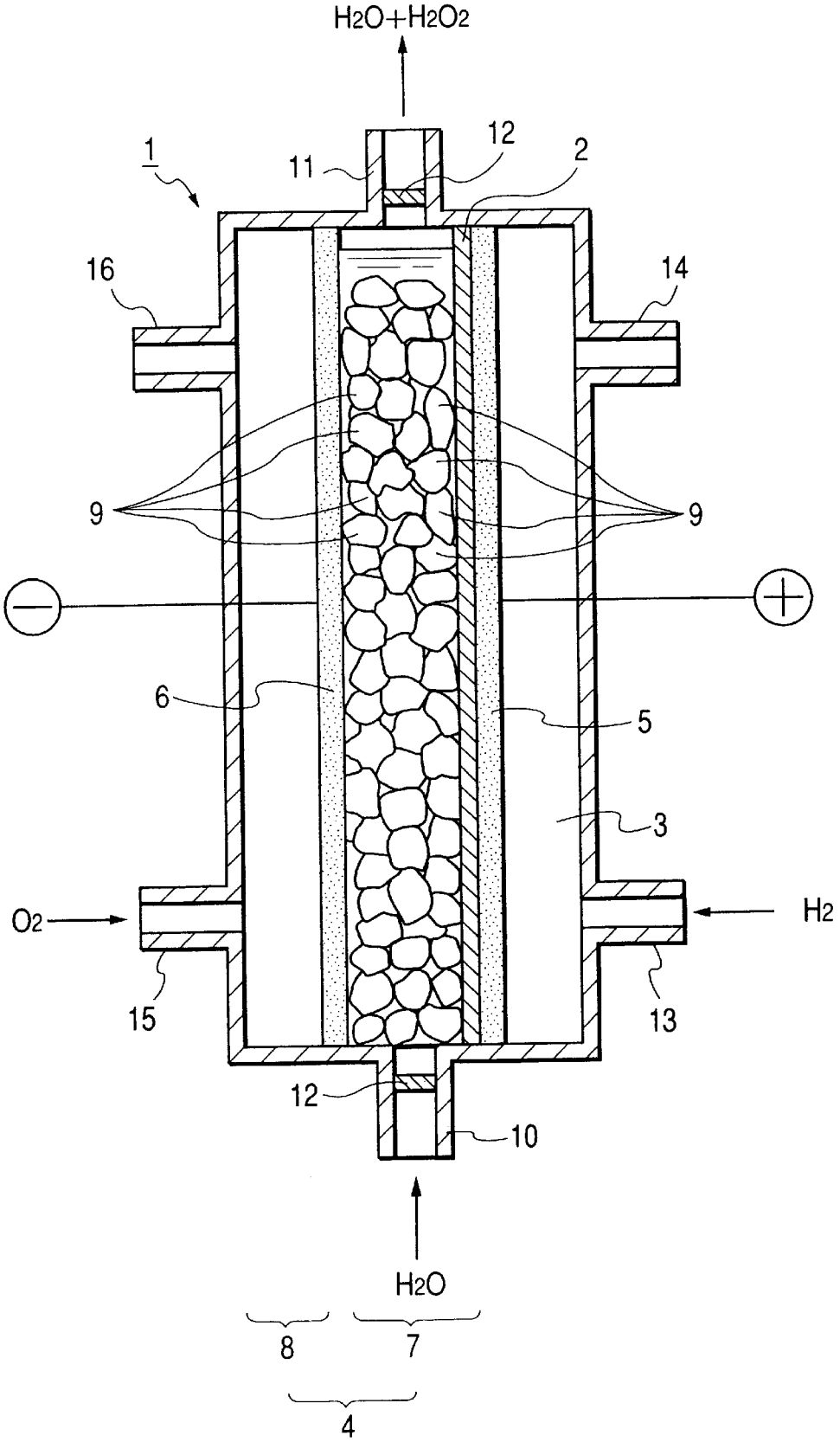
FIG. 1 is a diagrammatic vertical sectional view illustrating one embodiment of the two-chamber electrolytic cell for hydrogen peroxide production according to the present invention.

1 . . . electrolytic cell main body, 2 . . . ion-exchange membrane, 3. . . anode chamber, 4 . . . cathode chamber, 5 . . . gas diffusion anode, 6 . . . gas diffusion cathode, 7 . . . solution chamber, 8 . . . gas chamber, 9 . . . ion-exchange resin particle, 10 . . . ultrapure-water feed opening (or inlet), 11 . . . discharge opening (or inlet) for aqueous hydrogen peroxide solution, 12 . . . stopper for ion-exchange resin particles, 13 . . . hydrogen gas feed opening, 14 . . . gas discharge opening, 15 . . . oxygen gas feed opening, 16 . . . gas discharge opening, 21 . . . electrolytic cell main body, 22, 23 . . . ion-exchange membrane, 24 . . . anode chamber, 25 . . . intermediate chamber, 26 . . . cathode chamber, 27 . . . metal anode, 28 . . . metal cathode, 29 . . . matrix, 30 . . . ultrapure-water feed opening, 31 . . . discharge opening for aqueous hydrogen peroxide solution, 32 . . . anolyte feed opening, 33 . . . anolyte discharge opening, 34 . . . catholyte feed opening, 35 . . . catholyte discharge opening

DETAILED DESCRIPTION OF THE INVENTION

The process and electrolytic cell for producing hydrogen peroxide of the present invention can yield hydrogen peroxide at a relatively high current efficiency using a feed water having almost no electrical conductivity, such as ultrapure water.

In conventional processes for producing hydrogen peroxide from electrolytic liquids whose conductivity is substantially zero, such as pure water and ultrapure water, a slight amount of an electrolyte is added to the electrolytic liquids as stated hereinabove so as to enable current to pass through the liquids. In contrast, according to the present invention, an ion-conductive material, preferably an ion-exchange resin, is used to electrically connect the two electrodes to each other, so that even when an electrolytic liquid having substantially no electrical conductivity is used, a sufficient amount of current can be supplied to produce hydrogen peroxide at a high current efficiency. Furthermore, the use of a material such as an ion-exchange resin poses no problem concerning safety and, hence, the apparatuses are especially suitable for use as on-site electrolytic cells, which are highly desired.

In the electrolytic cell of the present invention, oxygen gas (or an oxygen-containing gas) is supplied to the cathode, while hydrogen gas or water is supplied to the anode. These gases can be externally fed, for example, from bombs. Alternatively, the two gases produced by water electrolysis can be directly fed to the electrolytic cell.

In the electrolytic production of hydrogen peroxide, the following electrode reactions generally occur. It is, however, possible to generate ozone and hydrogen peroxide on the anode by selecting a suitable anode catalyst.

Cathodic reaction:

$O_2+H_2O+2e^- \rightarrow OH^-+HO_2^-$ or $O_2+2H^++2e \rightarrow H_2O_2$

Anodic reaction:

$2H_2O \rightarrow O_2+4H^++4e$ or $H_2 \rightarrow 2H^++2e^-$

The electrolytic cell of the present invention may be either a two-chamber type or three-chamber type electrolytic cell. In the case of the two-chamber type, the cell is partitioned with one diaphragm into an anode chamber and a cathode chamber. The cathode chamber is used as a solution chamber because pure water or ultrapure water is supplied as a feed material to the cathode chamber, where hydrogen peroxide is to be generated. The anode chamber may be used as either a gas chamber or a solution chamber. Namely, electrolysis can be conducted while feeding, e.g., ultrapure water and hydrogen gas to the cathode chamber and the anode chamber, respectively. The pure or ultrapure water supplied to the cathode chamber preferably contains no added eletrolyte When a gas diffusion electrode is used as the cathode, a solution chamber is formed between the diaphragm and the gas diffusion electrode, and a gas chamber is formed on the opposite side of the gas diffusion electrode. In the case of the threechamber type, the cell is partitioned with two diaphragms into an anode chamber, an intermediate chamber, and a cathode chamber, and electrolysis can be conducted while feeding hydrogen gas to the anode chamber, pure water or ultrapure water to the intermediate chamber, and an oxygen-containing gas to the cathode chamber. The pure or ultrapure water supplied to the intermediate chamber preferably contains no added electrolyte. Also, preferably, an electrolyte is not supplied to either the two-chamber or three-chamber type electrolytic cell. The thickness of the cathode-side solution chamber in the two-chamber type or that of the intermediate chamber in the three-chamber type should be as small as possible in order to reduce the electrical resistance loss. However, from the standpoint of reducing the pump pressure loss in water feeding so as to maintain an even pressure distribution, the thickness of the solution or gas chamber is preferably about from 1 to 10 mm.

Each of the diaphragms is desirably an ion-exchange membrane from the standpoint of electrical conductivity. However, an inexpensive neutral membrane may be used although a slight voltage decrease results. The ion-exchange membrane may be either a fluororesin membrane or a hydrocarbon resin membrane. However, the former membrane is preferred from the standpoint of corrosion resistance. This diaphragm functions not only to prevent the ions which have generated on each of the anode and the cathode from being consumed on the counter electrode, but to cause the electrolysis to proceed smoothly even when the water has a low electrical conductivity. The diaphragm is preferably disposed in intimate contact with the electrodes so as to minimize the voltage drop.

The anode for use in the present invention is not particularly limited, and a suitable one may be selected from an oxygen-generating electrode, hydrogen-oxidizing electrode, gas diffusion electrode, etc., according to the electrolysis conditions. Examples of the oxygen-generating electrode include: an electrode which is a plate of an electrode material consisting mainly of a metal such as platinum, iridium, or ruthenium or an oxide of such a metal as a catalyst and is used as such; and an insoluble metal electrode obtained by depositing any of these catalysts on a corrosion-resistant base, e.g., a gauze, powder sinter, or metal fiber sinter made of titanium, niobium, tantalum, etc., by the pyrolysis method, bonding with a resin, composite plating, or another method in a coverage of from 1 to 500 g/m$^2$. Examples thereof further include diamond electrodes doped with boron.

The hydrogen-oxidizing electrode can be produced by depositing a metal such as platinum or iridium, an oxide thereof, or a carbon on the same base, e.g., a gauze, as in the oxygen-generating electrode in the same manner. It is desirable to scatteringly deposit a hydrophobic material and a hydrophilic material on the electrode in order to smoothly conduct liquid feeding and the removal of reaction product gases.

The cathode for use in the present invention is not particularly limited like the anode, and a suitable one may be selected from an oxygen-reducing electrode, gas diffusion electrode, etc., according to the electrolysis conditions Examples of the oxygen-reducing electrode include: an electrode which is a mere plate of a metal such as gold, silver, platinum, iridium, or palladium, an oxide thereof, a carbon such as graphite or electroconductive diamond, polyaniline, an organic material containing thiol (—SH) groups, or the like; and an electrode obtained by depositing any of these electrode materials on a corrosion-resistant base, e.g., a plate, gauze, powder sinter, or metal fiber sinter made of stainless steel, zirconium, silver, carbon, etc., by the pyrolysis method, bonding with a resin, composite plating, or another method in a coverage of from 1 to 1,000 g/m$^2$. As in the case of the anode, it is desirable to scatteringly deposit a hydrophobic material and a hydrophilic material on such an oxygen-reducing electrode in order to smoothly conduct liquid feeding and the removal of reaction product gases. A gas-permeable shield formed on the cathode on the side opposite the anode is effective.

The gas diffusion electrode is preferably an electrode which comprises a base made of carbon having, e.g., gold or platinum supported thereon and has a hydrophobic material scatteringly distributed therein. Also usable is a gas diffusion electrode of the so-called semihydrophobic type which has a hydrophilic reaction layer and a water-repellent gas diffusion layer on both sides.

In the case of using an oxygen gas diffusion electrode, a catholyte chamber may be disposed between a diaphragm and the gas diffusion electrode. However, use of a catholyte having a low electrical conductivity results in an increased cell voltage. In addition, the cell structure becomes complicated and material released from the gas diffusion electrode causes contamination. It is, therefore, desirable that the gas diffusion electrode be disposed in intimate contact with or be bonded to the diaphragm. The cathode chamber in this case serves substantially as a gas chamber. Also, in the case of using a hydrogen gas diffusion electrode, this electrode is desirably disposed in intimate contact with or bonded to the diaphragm The anode chamber in this case serves substantially as a gas chamber.

Examples of the ion-conductive material disposed between these electrodes include ion-exchange resins and matrixes comprising an electroconductive material. The ion-exchange resins include hydrocarbon resins such as styrene polymers, acrylic acid polymers and aromatic polymers. From the standpoint of corrosion resistance, the use of a fluororesin is preferred. Commercial resins include NR-50 (manufactured by E.I. du Pont de Nemours & Co.). Examples of the matrixes comprising an electroconductive material include a structure obtained by adhering an ionconductive ingredient (an ion-exchange resin dispersed in a solvent, e.g., a dispersion of Nafion, manufactured by E.I. du Pont de Nemours & Co.) to a supporting member in a porous, fibrous, or other form having a relatively large surface area (e.g., glass wool) and then forming the supporting member into, e.g., a net. The ion-conductive material for use in the present invention desirably has a porosity of from 20 to 90% from the standpoints of even dispersibility of liquid and resistivity. The pore size of a net-form matrix and the particle diameter of the ion-exchange resin are preferably from 0.1 to 10 mm.

Preferred electrolysis conditions include a liquid temperature of from 5 to 60° C. and a current density of from 1 to 100 $A/dm^2$. In the present invention, a current density of about 100 $A/dm^2$ is attainable by the use of an ion-exchange resin or the like as described above. The feed amount of hydrogen may be about 1.2 times the theoretical amount, while that of oxygen may be about from 1 to 2 times the theoretical amount.

The material of the electrolytic cell is preferably a glass-lined material, carbon, a highly corrosion-resistant material such as titanium or stainless steel, a PTFE resin, or the like from the standpoints of durability and hydrogen peroxide stability. In the case where the porous material having an ion-exchange ability disposed between the electrodes in the electrolytic cell is particulate or powdery, a highly corrosion-resistant stopper or the like can be disposed at each of the inlet and outlet for the electrolytic liquid in order to prevent the porous material from flowing out.

As stated hereinabove, hydrogen gas and oxygen gas may be fed from bombs, or hydrogen and oxygen gases generated by water electrolysis may be directly supplied to the electrolytic cell. In the latter case, an electrolytic apparatus which comprises an ion-exchange membrane and two electrodes respectively bonded to both sides of the membrane and for which pure water is used as a feed material is desirable from the standpoint of profitability. This is because high-purity hydrogen peroxide can be obtained with a small apparatus composed of a gas generator and an electrolytic cell united therewith. As stated hereinabove, this apparatus can be made to yield ozone by selecting a suitable catalyst. This structure is preferred from the standpoint of the effective utilization of energy.

By using the electrolytic cell described above and by regulating the water feed rate and the current density, the concentration of hydrogen peroxide thus produced can be regulated to a value in the range of from 1 to 10,000 ppm (1 wt %). When pure water containing hydrogen peroxide dissolved therein is supplied to the electrolytic cell in the initial stage of electrolysis, hydrogen peroxide can be efficiently produced from the start of electrolysis at a low voltage.

Examples of the electrolytic cell for hydrogen peroxide production according to the present invention will be described below by reference to the accompanying drawings. However, the present invention should not be construed as being limited to these examples.

FIG. 1 is a diagrammatic vertical sectional view illustrating one embodiment of the two-chamber electrolytic cell for hydrogen peroxide production according to the present invention.

The electrolytic cell main body 1 is partitioned with an ion-exchange membrane 2 into an anode chamber 3 and a cathode chamber 4. The ion-exchange membrane 2 has, on its side facing the anode chamber, a gas diffusion anode 5 in intimate contact therewith. In the cathode chamber 4, a gas diffusion cathode 6 is disposed apart from the ion-exchange membrane 2 so that the cathode 6 is in contact with the top and bottom of the electrolytic cell main body 1 to partition the cathode chamber into a solution chamber 7 on the side facing the anode chamber and a gas chamber 8 on the opposite side.

The solution chamber 7 is packed with ion-exchange resin particles 9. The bottom and top of the solution chamber 7 respectively have an ultrapure-water feed opening 10 and a discharge opening 11 for an aqueous hydrogen peroxide solution. The feed opening 10 and the discharge opening 11 each has, disposed therein, a stopper 12 for preventing the ion-exchange resin particles from flowing out. The anode chamber has a hydrogen gas feed opening 13 and an excess-gas discharge opening 14 formed in lower and upper parts of the anode chamber, respectively. Furthermore, the cathode chamber has an oxygen gas feed opening 15 and an excess-gas discharge opening 16 formed in lower and upper parts of the cathode chamber, respectively.

When a voltage is applied to the two electrodes in this electrolytic cell main body 1, which has the structure described above, while feeding hydrogen gas to the anode chamber 3 through the hydrogen gas feed opening 13 and an oxygen-containing gas to the gas chamber 8 in the cathode chamber through the oxygen gas feed opening 15 and further feeding ultrapure water to the solution chamber 9 in the cathode chamber through the ultrapure-water feed opening 10, a current flows through the anode 5 and the cathode 6 at a relatively high current density despite the fact that the electrical conductivity of the ultrapure water used as an electrolytic liquid is nearly zero. This is because the two electrodes are electrically connected to each other via the ion-exchange membrane 2 and the ionexchange resin particles 9, both having electrical conductivity. In addition, since the electrolytic liquid that is used is ultrapure water, the aqueous hydrogen peroxide solution which generates in the solution chamber 7 and is taken out through the discharge opening 11 is a high-purity product having a high concentration and containing substantially no impurities. This hydrogen peroxide solution can hence be used in a wide range of applications.

Figure 2:
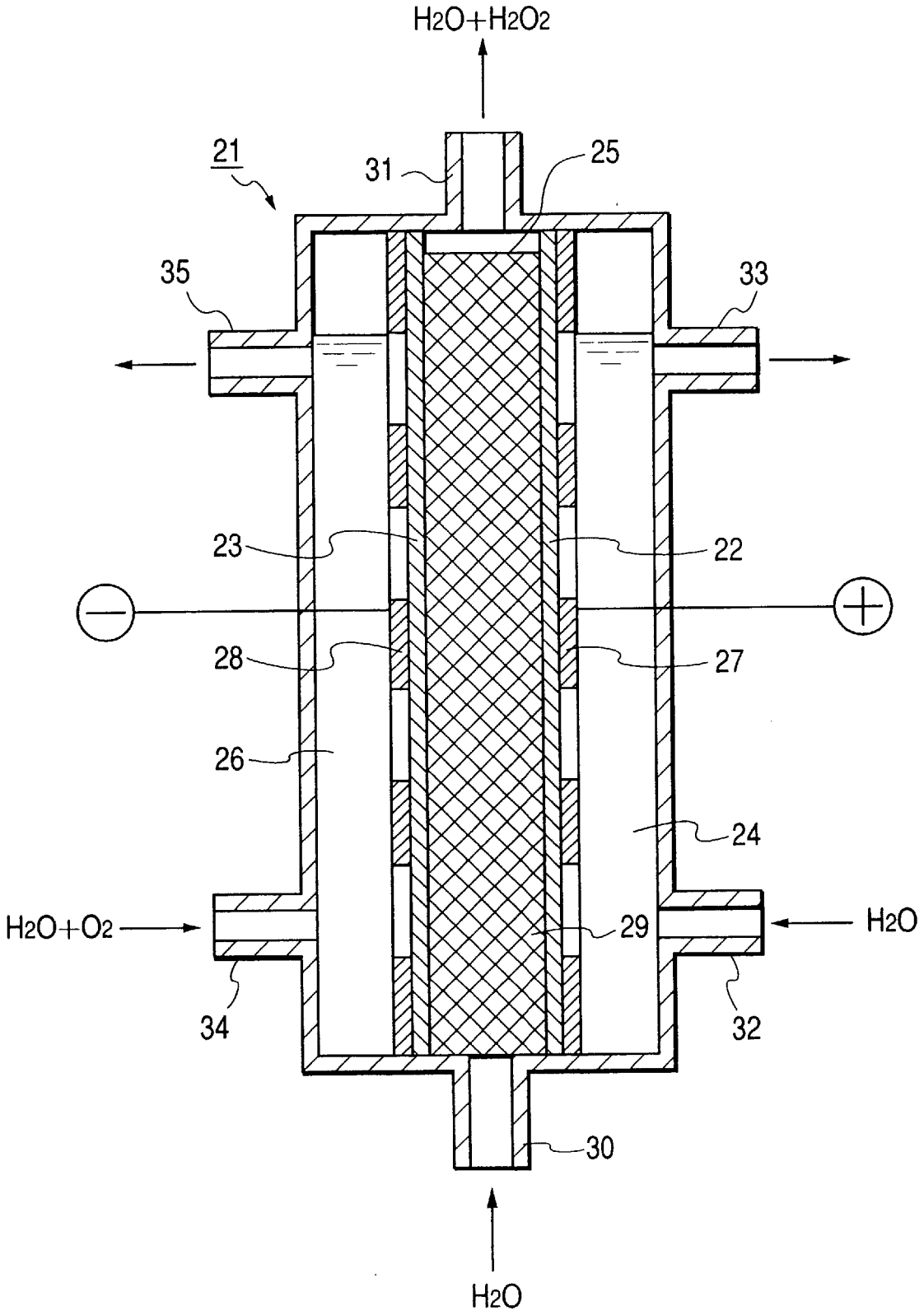
FIG. 2 is a diagrammatic vertical sectional view illustrating one embodiment of the three-chamber electrolytic cell for hydrogen peroxide production according to the present invention.

FIG. 2 is a diagrammatic vertical sectional view illustrating one embodiment of the three-chamber electrolytic cell for hydrogen peroxide production according to the present invention.

The electrolytic cell main body 21 is partitioned with two ion-exchange membranes 22 and 23 into an anode chamber 24, an intermediate chamber 25, and a cathode chamber 26. The ion-exchange membrane 22 disposed on the anode side has, on its side facing the anode chamber, a metal anode 27 in intimate contact therewith. The ion-exchange membrane 23 disposed on the cathode side has, on its side facing the cathode chamber, a metal cathode 28 in intimate contact therewith. In the intermediate chamber 25 is placed a matrix 29 which comprises a support of a net structure and an ion-conductive ingredient deposited thereon.

The bottom and top of the intermediate chamber 25 respectively have an ultrapure-water feed opening 30 and a discharge opening 31 for an aqueous hydrogen peroxide solution. The anode chamber has an anolyte feed opening 32 and an anolyte discharge opening 33 respectively formed in lower and upper parts of the anode chamber. Furthermore, the cathode chamber has a catholyte feed opening 34 and a catholyte discharge opening 35 respectively formed in lower and upper parts of the cathode chamber. In the case where the ion-exchange membranes 22 and 23 are liquid-permeable, there is no need to feed a liquid to the intermediate chamber 25. The oxygen for use as a feed material is fed by dissolving the gas in a catholyte or bubbling the gas into the cathode chamber.

In this electrolytic cell main body 21 also, which has the structure described above, a current flows through the metal anode 27 and the metal cathode 28 at a relatively high current density despite the fact that the electrical conductivity of the ultrapure water used as an electrolytic liquid is nearly zero. This is because the two electrodes are electrically connected to each other via the ion-exchange membranes 22 and 23 and the matrix 29, each having electrical conductivity. Thus, high-purity hydrogen peroxide containing almost no impurities can be produced.

Examples of the production of hydrogen peroxide according to the present invention are given below. However, these Examples should not be construed as limiting the scope of the invention.

EXAMPLE 1

A gas- and liquid-permeable, porous carbon anode having a platinum catalyst deposited thereon and a porous carbon cathode having a gold catalyst deposited thereon were prepared each having an electrode area of 20 $cm^2$. An electrolytic cell having the structure shown in FIG. 1 was fabricated by bringing the anode into intimate contact with cation-exchange membrane Nafion 117, manufactured by E.I. du Pont de Nemours & Co., disposing the cathode on the opposite side of the cation-exchange membrane so that the distance between the cathode and the anode was 5 mm, and packing Nafion Resin NR-50 into the space between the cation-exchange membrane and the cathode. Hydrogen gas and oxygen gas were fed each at a rate of 10 ml/min to the anode chamber of the electrolytic cell and the cathode-side gas chamber, respectively, from an industrial hydrogen bomb and an industrial oxygen bomb. Ultrapure water was fed to the cathodeside solution chamber at a rate of 50 ml/min. A current of 3 A was passed through the electrolytic cell at a temperature of 30° C. As a result, the cell voltage was 4 V and an aqueous hydrogen peroxide solution having a hydrogen peroxide concentration of 200 ppm was obtained through the discharge opening of the solution chamber at a current efficiency of about 15%.

EXAMPLE 2

A porous carbon anode having an electroconductive diamond catalyst (doped with boron in a concentration of 1,000 ppm) deposited thereon and having an electrode area of 20 $cm^2$ was prepared. A porous cathode having an electrode area of 20 $cm^2$ was further prepared by molding an electroconductive diamond catalyst powder into a 0.5 mm-thick sheet form with a fluororesin and press-bonding a hydrophobic sheet (Poreflon, manufactured by Sumitomo Electric Industries, Ltd.; thickness, 0.03 mm) to the back side of the above sheet. The two electrodes were disposed in an electrolytic cell so that the electrodes were 10 mm apart from each other. Nafion Resin NR-50 was packed into the space between the electrodes. Oxygen gas was fed to the cathode chamber at a rate of 10 ml/min in the same manner as in Example 1, and ultrapure water was fed to the anode chamber at a rate of 50 ml/min A current of 1 A was passed through the electrolytic cell at a temperature of 25° C. As a result, the cell voltage was 10 V and an aqueous hydrogen peroxide solution having a hydrogen peroxide concentration of 20 ppm was obtained through the discharge opening of the anode chamber at a current efficiency of about 10%. In addition to hydrogen peroxide, the aqueous solution contained ozone and oxygen which both had generated on the anode.

EXAMPLE 3

An electrolytic cell having the same structure as in Example 1 was fabricated, except that a matrix obtained by coating a quartz glass wool with a Nafion resin fluid and burning the coated wool was packed in place of the ion-exchange resin particles into the cathode-side solution chamber. Electrolysis was conducted under the same conditions as in Example 1. As a result, the cell voltage was 4 V and an aqueous hydrogen peroxide solution having a hydrogen peroxide concentration of 100 ppm was obtained through the discharge opening of the solution chamber at a current efficiency of about 8%.

COMPARATIVE EXAMPLE 1

An electrolytic cell having the same structure as in Example 1 was fabricated, except that the solution chamber was not packed with the ion-exchange resin particles. Electrolysis was conducted under the same conditions as in Example 1. As a result, the value of current was not so large, and the cell voltage at a current of 2 mA was 40 V. The aqueous hydrogen peroxide solution obtained from the solution chamber had a concentration of 1 ppm or lower.

As described above, the process for hydrogen peroxide production of the present invention, which comprises conducting water electrolysis, while feeding water and an oxygen-containing gas as feed materials, in an electrolytic cell partitioned with one or more diaphragms at least into an anode chamber and a cathode chamber, is characterized in that the cell has an ion-conductive material disposed between the anode and the cathode to electrically connect the two electrodes to each other.

The present invention is effective in producing hydrogen peroxide, in which pure water or ultrapure water, each having a low impurity content and exceedingly low electrical conductivity, is used as feed water. This is because the two electrodes are electrically connected to each other with the ion-conductive material, and the current density, which directly influences hydrogen peroxide production, can hence be sufficiently heightened even when the conductivity of the electrolytic liquid is substantially zero.

Furthermore, due to the ion-conductive material, the space through which feed water passes is secured within an electrode chamber, whereby the feed water flows through the cell without suffering considerable flow resistance. Namely, an even pressure distribution is attained, and hydrogen peroxide can be produced under satisfactory electrolysis conditions.

The electrolytic cell of the present invention may be either a two-chamber or three-chamber type cell. Use of optimal ion-exchange resin particles as the packed ion-conductive material to be packed is advantageous in that cell fabrication is easy and the electrodes can be electrically connected without fail.

While the invention has been described in detail and with reference to specific embodiments thereof, it will be apparent to one skilled in the art that various changes and modifications can be made therein without departing from the spirit and scope thereof.

What is claimed is:

1. A process for producing hydrogen peroxide in an electrolytic cell partitioned with an ion-exchange membrane into an anode chamber including an anode electrode and a cathode chamber including a cathode electrode and having an ion-conductive material comprising an ion-exchange resin disposed between the anode electrode and the cathode electrode, which comprises supplying water and an oxygen-containing gas to said electrolytic cell and passing an electric current through the electrolytic cell to electrolyze the water, said cathode electrode being separated from the ion-exchange membrane by said ion-conductive material, said ion-exchange membrane being electrically connected to the cathode electrode via the ion-conductive material, and said ion-exchange membrane being disposed in intimate contact with the anode electrode.

2. The process as claimed in claim 1, wherein said cathode electrode is a gas diffusion electrode, and said cathode chamber comprises a solution chamber containing said ion-conductive material formed between the diaphragm and a first side of the gas diffusion electrode and a gas chamber formed on an opposite side of the gas diffusion electrode.

3. The process as claimed in claim 2, which comprises supplying water to the solution chamber, an oxygen-containing gas to the gas chamber and hydrogen to the anode chamber.

4. The process as claimed in claim 1, wherein the water supplied to said electrolytic cell does not contain an added electrolyte.

5. The process as claimed in claim 1, wherein an electrolyte is not supplied to said electrolytic cell.

6. The process as claimed in claim 1, which comprises current through the cell at a current density of from 1 to 100 $A/dm^2$.

7. An electrolytic cell for producing hydrogen peroxide partitioned with a diaphragm into an anode chamber including an anode electrode and a cathode chamber including a cathode electrode and having an ion-conductive material packed in at least one of the anode and cathode chambers, said diaphragm being electrically connected to the anode electrode or cathode electrode via the ion-conductive material, wherein the cathode electrode is separated from the diaphragm by said ion-conductive material, said diaphragm is electrically connected to the cathode electrode via the ion-conductive material, said cathode electrode is a gas diffusion electrode, and said cathode further comprises a solution chamber containing said ion-conductive material formed between the diaphragm and a first side of the gas diffusion electrode and a gas chamber formed on an opposite side of the gas diffusion electrode.

8. The electrolytic cell as claimed in claim 7, wherein said solution chamber has a thickness of about from 1 to 10 mm.

9. The electrolytic cell as claimed in claim 7, wherein said diaphragm is disposed in intimate contact with the anode electrode.

10. The electrolytic cell as claimed in claim 7, wherein said ion-conductive material comprises at least one of an ion-exchange resin and a matrix containing an electroconductive material.

11. The electrolytic cell as claimed in claim 10, wherein said ion-conductive material comprises an ion-exchange resin.

12. A process for producing hydrogen peroxide in an electrolytic cell partitioned with first and second diaphragms into an anode chamber including an anode electrode, an intermediate chamber and a cathode chamber including a cathode electrode and having an ionconductive material packed in the intermediate chamber, said first and second diaphragms being electrically connected to each other via the ion-conductive material, which comprises supplying an oxygen-containing gas to the cathode chamber, water to the intermediate chamber and hydrogen to the anode chamber and passing an electric current through the electrolytic cell to electrolyze the water.

13. The process as claimed in claim 12, wherein said intermediate chamber is formed between said first and second diaphragms and has a thickness of about from 1 to 10 mm.

14. The process as claimed in claim 12, wherein said first and second diaphragms are disposed in intimate contact with said anode and cathode electrodes, respectively.

* * * * *